US011697122B2

(12) United States Patent
Pledger

(10) Patent No.: US 11,697,122 B2
(45) Date of Patent: Jul. 11, 2023

(54) PLACER RECOVERY OF PARTICLES AND RELATED SYSTEMS, METHODS, AND DEVICES

(71) Applicant: Jerry Pledger, Salt Lake City, UT (US)

(72) Inventor: Jerry Pledger, Salt Lake City, UT (US)

( * ) Notice: Subject to any disclaimer, the term of this patent is extended or adjusted under 35 U.S.C. 154(b) by 0 days.

(21) Appl. No.: 17/648,641

(22) Filed: Jan. 21, 2022

(65) Prior Publication Data

US 2022/0234051 A1 Jul. 28, 2022

Related U.S. Application Data

(60) Provisional application No. 63/140,317, filed on Jan. 22, 2021.

(51) Int. Cl.
*B03B 5/40* (2006.01)

(52) U.S. Cl.
CPC ..... *B03B 5/40* (2013.01); *B03B 2005/405* (2013.01)

(58) Field of Classification Search
CPC .... B03B 5/40; B03B 5/26; B03B 5/28; B03B 5/68; B03B 5/623; B03B 2005/405
USPC ..... 209/266
See application file for complete search history.

(56) References Cited

U.S. PATENT DOCUMENTS 1,725,765 A * 8/1929 Rea ..... B03B 5/26 209/458
2,038,931 A * 4/1936 Goldberg ..... B07B 1/18 209/268
2,073,122 A * 3/1937 Picton ..... E21C 50/00 299/8
3,420,576 A * 1/1969 Butler ..... E21C 45/00 299/8
8,789,780 B2 * 7/2014 Brosseuk ..... E21C 45/00 299/8

FOREIGN PATENT DOCUMENTS

CN 110140530 A * 8/2019 ..... A01F 12/18

* cited by examiner

*Primary Examiner* — Michael McCullough
*Assistant Examiner* — Jessica L Burkman
(74) *Attorney, Agent, or Firm* — Stoel Rives LLP

(57) ABSTRACT

Material collection devices, placer recovery systems, and related methods are disclosed. A material collection device includes a filter tube including a wall defining apertures, an inlet through which fluid and material enter the filter tube, protrusions extending inwardly from the wall of the filter tube, the protrusions in front of the apertures from a perspective of the inlet, and an outlet through which the fluid and material exit the filter tube. The material collection device also includes a collector positioned below the filter tube, the collector configured to collect particles of the material that exit the filter tube through the apertures.

16 Claims, 8 Drawing Sheets

PLACER RECOVERY OF PARTICLES AND RELATED SYSTEMS, METHODS, AND DEVICES

CROSS-REFERENCE TO RELATED APPLICATIONS

This application claims priority to U.S. Provisional Patent Application No. 63/140,317, filed Jan. 22, 2021, and titled PLACER RECOVERY OF PARTICLES AND RELATED SYSTEMS, METHODS, AND DEVICES, the entire disclosure of which is hereby incorporated herein by this reference.

TECHNICAL FIELD

This disclosure relates generally to placer recovery of particles in a stream, and more specifically to recovery of particles that are heavier than other particles in a stream.

BACKGROUND

Materials such as precious metals (e.g., gold) may accumulate in stream or river beds. Given the high value of precious metals, profit may be obtained from harvesting materials from stream or river beds.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

Figure 1:
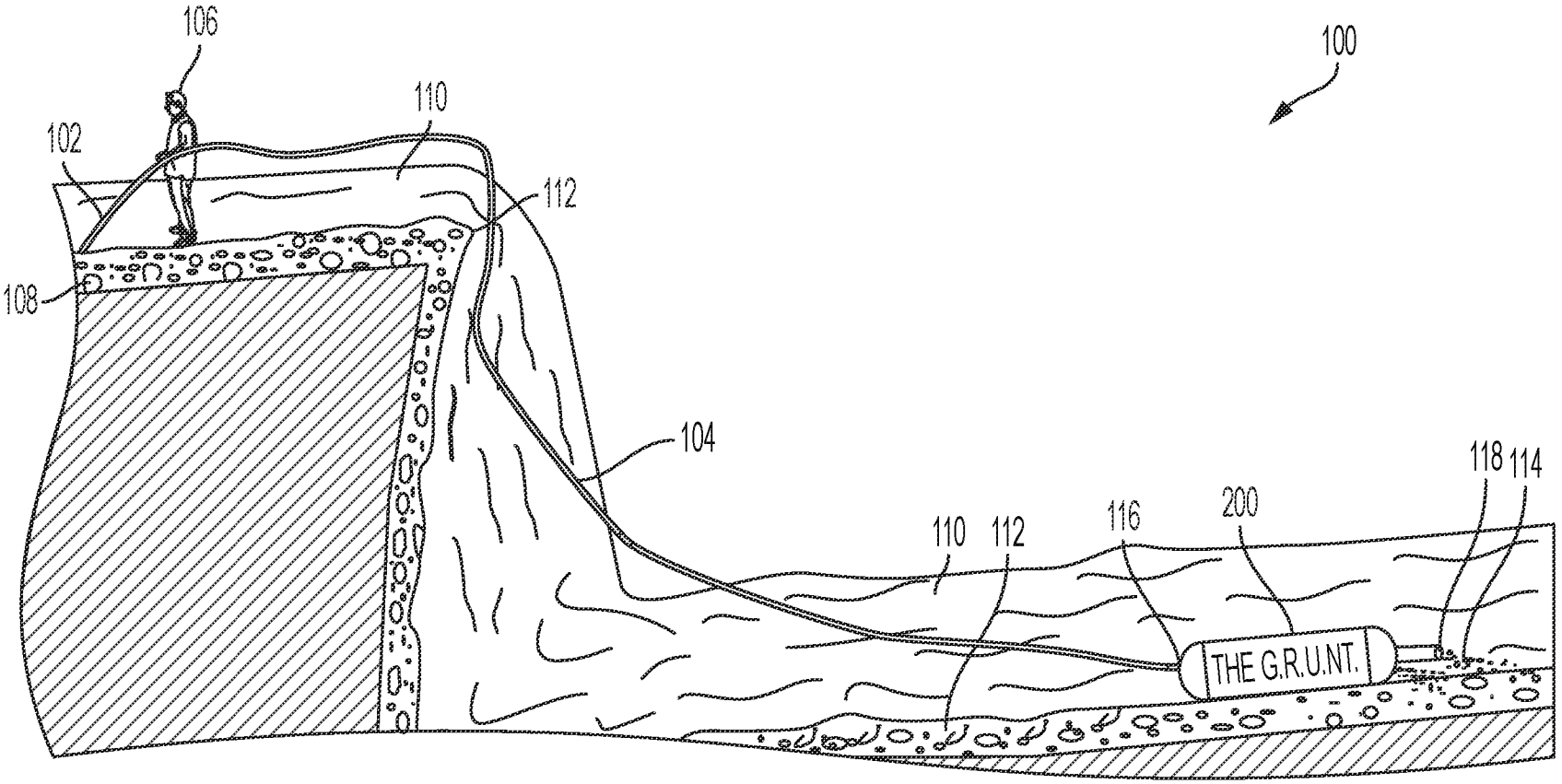
FIG. 1 is a side view of a placer recovery system, according to some embodiments.

In the following detailed description, reference is made to the accompanying drawings, which form a part hereof, and in which are shown, by way of illustration, specific examples of embodiments in which the present disclosure may be practiced. These embodiments are described in sufficient detail to enable a person of ordinary skill in the art to practice the present disclosure. However, other embodiments enabled herein may be utilized, and structural, material, and process changes may be made without departing from the scope of the disclosure.

The illustrations presented herein are not meant to be actual views of any particular method, system, device, or structure, but are merely idealized representations that are employed to describe the embodiments of the present disclosure. In some instances similar structures or components in the various drawings may retain the same or similar numbering for the convenience of the reader; however, the similarity in numbering does not necessarily mean that the structures or components are identical in size, composition, configuration, or any other property.

The following description may include examples to help enable one of ordinary skill in the art to practice the disclosed embodiments. The use of the terms "exemplary," "by example," and "for example," means that the related description is explanatory, and though the scope of the disclosure is intended to encompass the examples and legal equivalents, the use of such terms is not intended to limit the scope of an embodiment or this disclosure to the specified components, steps, features, functions, or the like.

It will be readily understood that the components of the embodiments as generally described herein and illustrated in the drawings could be arranged and designed in a wide variety of different configurations. Thus, the following description of various embodiments is not intended to limit the scope of the present disclosure, but is merely representative of various embodiments. While the various aspects of the embodiments may be presented in the drawings, the drawings are not necessarily drawn to scale unless specifically indicated.

Furthermore, specific implementations shown and described are only examples and should not be construed as the only way to implement the present disclosure unless specified otherwise herein. Elements, circuits, and functions may be shown in block diagram form in order not to obscure the present disclosure in unnecessary detail. Conversely, specific implementations shown and described are exemplary only and should not be construed as the only way to implement the present disclosure unless specified otherwise herein. Additionally, block definitions and partitioning of logic between various blocks is exemplary of a specific implementation. It will be readily apparent to one of ordinary skill in the art that the present disclosure may be practiced by numerous other partitioning solutions. For the most part, details concerning timing considerations and the like have been omitted where such details are not necessary to obtain a complete understanding of the present disclosure and are within the abilities of persons of ordinary skill in the relevant art.

The embodiments may be described in terms of a process that is depicted as a flowchart, a flow diagram, a structure diagram, or a block diagram. Although a flowchart may describe operational acts as a sequential process, many of these acts can be performed in another sequence, in parallel, or substantially concurrently. In addition, the order of the acts may be re-arranged. A process may correspond to a method, a function, a procedure, other structure, or combinations thereof.

Any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner. In addition, unless stated otherwise, a set of elements may include one or more elements.

As used herein, the term "substantially" in reference to a given parameter, property, or condition means and includes to a degree that one of ordinary skill in the art would understand that the given parameter, property, or condition is met with a small degree of variance, such as, for example, within acceptable manufacturing tolerances. By way of example, depending on the particular parameter, property, or condition that is substantially met, the parameter, property, or condition may be at least 90% met, at least 95% met, or even at least 99% met.

Recovery of materials from stream or river beds may involve a great deal of work in treacherous conditions, which may result in injury or even death to individuals harvesting the materials, and may result in damage or destruction to equipment and other property. Also, given an often small proportion of desired materials in stream or river beds compared to larger proportions of undesired or worthless materials, it may be difficult to harvest a sufficient amount of desired materials to make the recovery process worthwhile.

Disclosed herein are material collection devices, placer recovery systems, and related methods that facilitate recovery of desired materials from stream or river beds. Embodiments herein improve safety to individuals harvesting the materials, reduce the probability of damage to equipment, and quickly and easily collect heavy materials such as gold from undesired or worthless materials.

In some embodiments a material collection device includes a filter tube and a collector positioned below the filter tube. The filter tube includes a wall defining apertures, an inlet through which fluid and material enter the filter tube, protrusions extending inwardly from the wall of the filter tube, and an outlet through which the fluid and the material exit the filter tube. The protrusions are in front of the apertures from a perspective of the inlet. The collector is configured to collect particles of the material that exit the filter tube through the apertures.

In some embodiments a placer recovery system includes a material collection device, a material intake device, and a material transmission device. The material collection device includes a filter tube extending therethrough and a collector positioned below the filter tube. The filter tube includes apertures and protrusions in front of the apertures from a perspective of an inlet of the filter tube. The material intake device intakes material from a streambed and fluid from the stream. The material transmission device delivers the material and fluid from the material intake device to the material collection device.

In some embodiments a method of operating a placer recovery system includes intaking, by a material intake device, material from a streambed and fluid from a stream and delivering the material and the fluid from the material intake device to a material collection device. The method also includes collecting first particles on a collector of the material collection device, the first particles sufficiently dense to exit a filter tube through one or more apertures having protrusions in front of the one or more apertures.

FIG. 1 is a side view of a placer recovery system 100, according to some embodiments. The placer recovery system 100 includes a material collection device 200, a material intake device 102, and a material transmission device 104. The material collection device 200 includes a filter tube (not shown in FIG. 1) extending therethrough, the filter tube including apertures and protrusions in front of the apertures from a perspective of an inlet 116 of the filter tube and a collector (not shown in FIG. 1) positioned below the filter tube, as will be discussed in more detail below. The material intake device 102 intakes material 108 from a streambed 112 or a river bed and fluid from a stream 110. The material transmission device 104 delivers the material 108 and fluid 410 (see FIG. 4) from the material intake device 102 to the material collection device 200. As used herein, the term "streambed" refers to a bottom or bed of any body of water including a stream, a river, a canal, a pond, a lake, a puddle, an ocean, or other body of water.

In operation an operator 106 may utilize the material intake device 102 to intake the material 108 from the streambed 112, the material transmission device 104 may deliver the material 108 and fluid to the inlet 116 of the material collection device 200, and the material collection device 200 may collect desirable particles of the material 108, and discharge, from an outlet 118 of the material collection device 200, discarded material 114 including undesired materials of the material 108.

Figure 2:
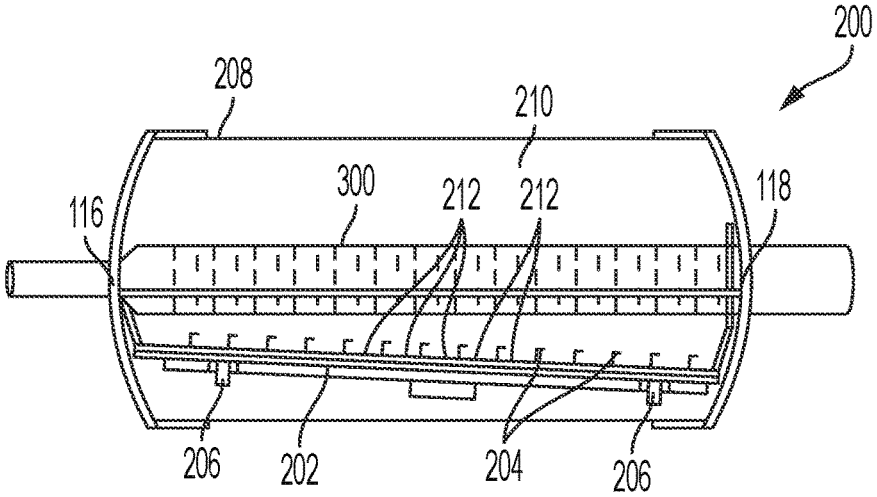
FIG. 2 is a side view of a material collection device of the placer recovery system of FIG. 1, according to some embodiments.
Figure 3:
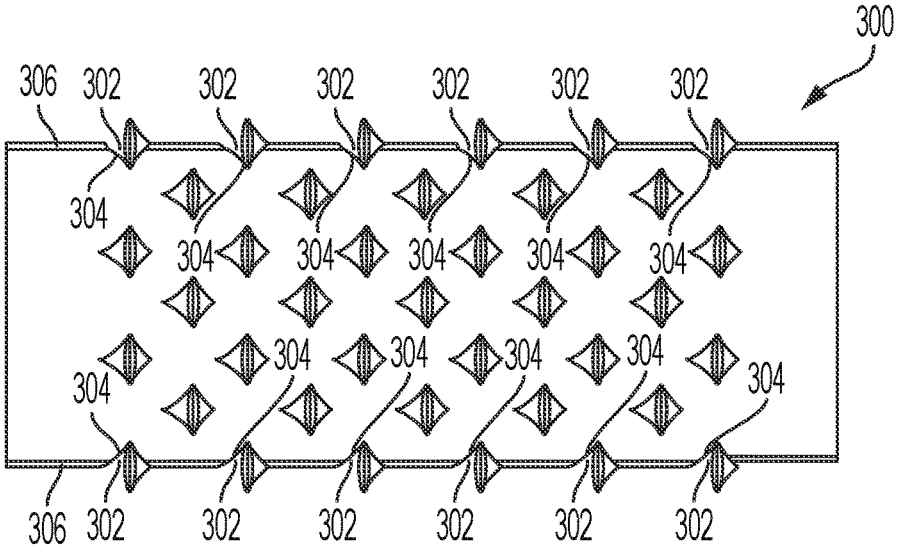
FIG. 3 is a side view of a portion of a filter tube of the material collection device of FIG. 2, according to some embodiments.

FIG. 2 is a side view of a material collection device 200 of the placer recovery system 100 of FIG. 1, according to some embodiments. The material collection device 200 includes a shell 208, a filter tube 300, and a collector 202 positioned below the filter tube 300. The shell 208 defines a collection chamber 210. The filter tube 300 extends through the collection chamber 210. The collector 202 is positioned within the collection chamber 210 below the filter tube 300. The filter tube 300 includes an inlet 116 through which fluid and material enter the filter tube 300. The filter tube 300 also includes an outlet 118 through which the fluid and material exit the filter tube 300. FIG. 3 illustrates more detail regarding the filter tube 300.

FIG. 3 is a side view of a portion of a filter tube 300 of the material collection device 200 of FIG. 2, according to some embodiments. The filter tube 300 includes a wall 306 defining apertures 302. The filter tube 300 also includes protrusions 304 extending inwardly from the wall 306 of the filter tube 300. The protrusions are positioned in front of the apertures 302 from a perspective of the inlet 116 (FIG. 1 and FIG. 2).

Figure 4:
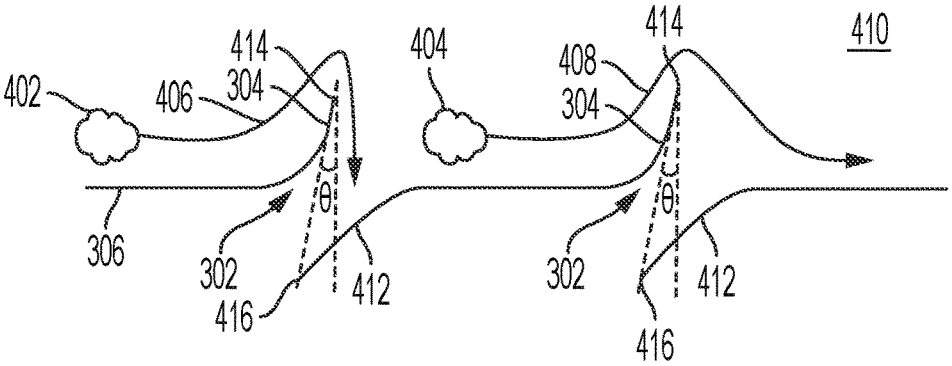
FIG. 4 is a zoomed-in side view of a sub-portion of the filter tube of FIG. 3.

FIG. 4 is a zoomed-in side view of a sub-portion of the filter tube 300 of FIG. 3. FIG. 4 illustrates the wall 306, apertures 302 in the wall 306, and protrusions 304 extending inwardly from the wall 306 in front of the apertures 302. FIG. 4 also illustrates a first particle 402 and a second particle 404. The first particle 402 may be a denser particle than the second particle 404. By way of non-limiting example, the first particle 402 may be a gold particle, which is desired to be collected by the material collection device 200 (FIG. 2). Since the first particle 402 is denser than the second particle 404, the first particle 402 may have an exit path 406 that has a steeper descent following the protrusions 304 than a retention path 408 of the second particle 404. As a result, the first particle 402 may exit the filter tube 300 through one of the apertures 302, and the second particle 404 may be retained within the filter tube 300 until it reaches the outlet 118 and is discarded as discarded material 114 (FIG. 1).

In addition to the protrusions 304, which extend inwardly into the filter tube 300 (FIG. 3) from the wall 306, in some embodiments the filter tube 300 may also include outward protrusions 412, which may protrude outwards from the wall 306. The outward protrusions 412 may be positioned behind the apertures 302 from a perspective of the inlet 116 (FIG. 1). In some embodiments an angle θ between a line perpendicular to the wall 306 and a line from a tip 414 of one of the protrusions 304 to a tip 416 of a corresponding one of the outward protrusions 412 may be between 5° and 55°. By way of non-limiting example, the angle θ may be substantially 30°. Although not shown in FIG. 4, the angle θ may be substantially 0° (e.g., the line from the tip 414 to the tip 416 may be substantially perpendicular to the wall 306.

Returning to FIG. 2, the collector 202 is configured to collect particles (e.g., first particle 402 of FIG. 4) of the material 108 that exit the filter tube 300 through the apertures 302. The collector 202 may include ridges 204 on a top surface thereof to prevent collected particles that collect thereon from leaving the top surface. In some embodiments the collector 202 may include eddy features 212 formed therein instead of or in addition to the ridges 204 to induce eddies in the fluid within the collection chamber 210 proximate to the ridges 204. Such eddies may encourage particles leaving the filter tube 300 (e.g., through the apertures 302 of FIG. 3 and FIG. 4) to travel toward and rest on the collector 202 (e.g., on or in the ridges 204 and/or on or in the eddy features).

The collector 202 may also include rollers 206 configured to engage with an inner surface of the shell 208 to maintain the collector 202 in a substantially horizontal orientation (e.g., slightly slanted as shown in FIG. 2) under the filter tube 300 regardless of an orientation of the material collection device 200. In other words, the collector 202 is configured to remain below the filter tube 300 regardless of an orientation of the material collection device 200. As a result, if the material collection device 200 rolls around within a stream during operation, the collector 202 remains below the filter tube 300 and may continue to collect particles. Also, as illustrated in FIG. 3, the apertures 302 and their corresponding protrusions 304 are arranged substantially all around the wall 306 to enable the particles of the material to exit the filter tube 300 through the apertures 302 regardless of an orientation of the filter tube 300.

Figure 5A:
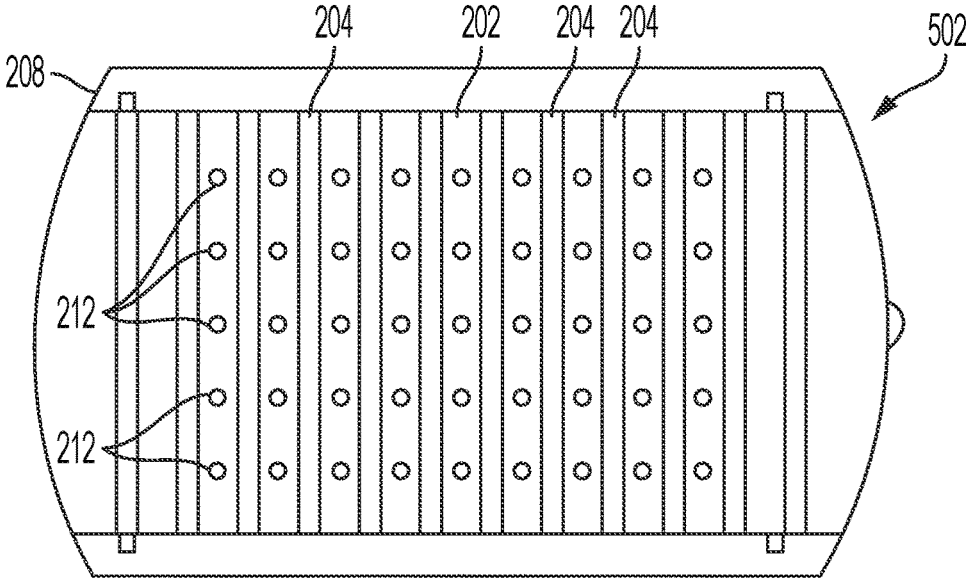
FIG. 5A illustrates a top view of the collector within the shell of the material collection device of FIG. 2, according to some embodiments.

FIG. 5A illustrates a top view 502 of the collector 202 within the shell 208 of the material collection device 200 of FIG. 2, according to some embodiments.

Figure 5B:
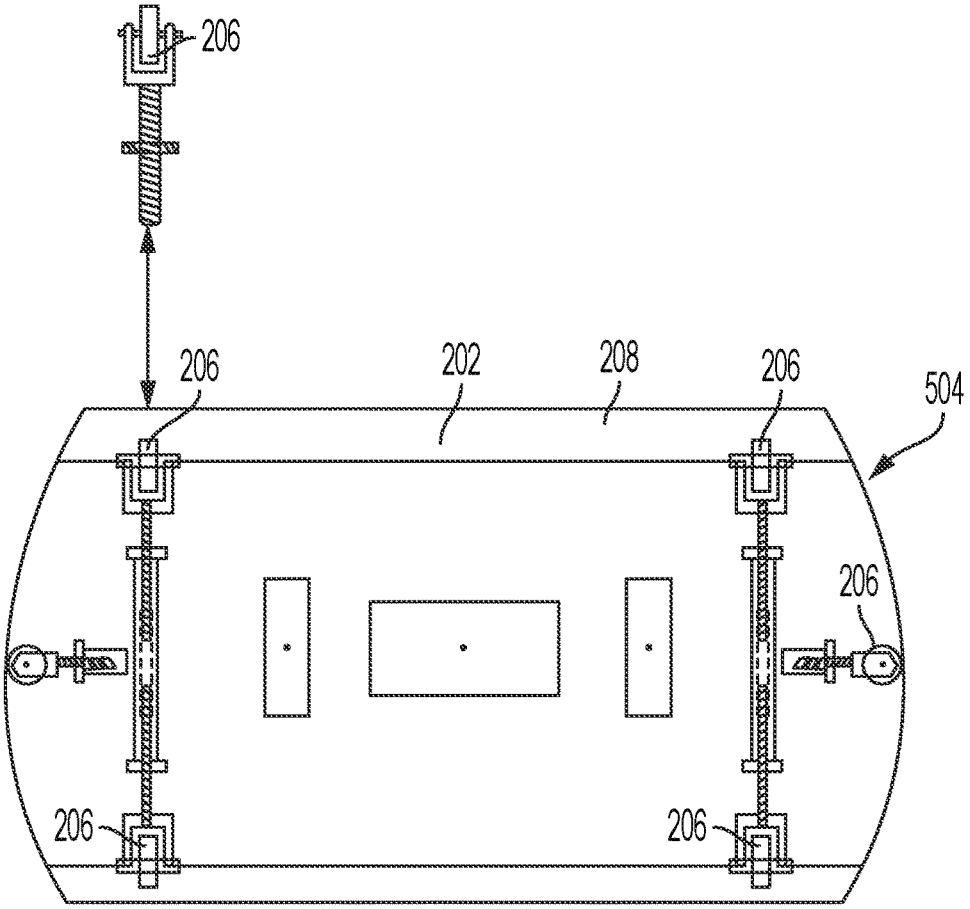
FIG. 5B illustrates a bottom view of the collector within the shell of the material collection device of FIG. 2, according to some embodiments.

FIG. 5B illustrates a bottom view 504 of the collector 202 within the shell 208 of the material collection device 200 of FIG. 2, according to some embodiments.

Referring to FIG. 5A and FIG. 5B together, the bottom view 504 shows the rollers 206, and the top view shows the ridges 204 and the eddy features 212. As illustrated in FIG. 5B, the rollers 206 may be secured to the collector 202 via threaded members, which may enable rotation of the threaded members to change a position of the rollers 206. In some embodiments the eddy features 212 may include swirl patterns therein to induce the fluid (e.g., the fluid 410 of FIG. 4) to eddy (e.g., to swirl around) responsive to the fluid passing over the eddy features 212.

Figure 6:
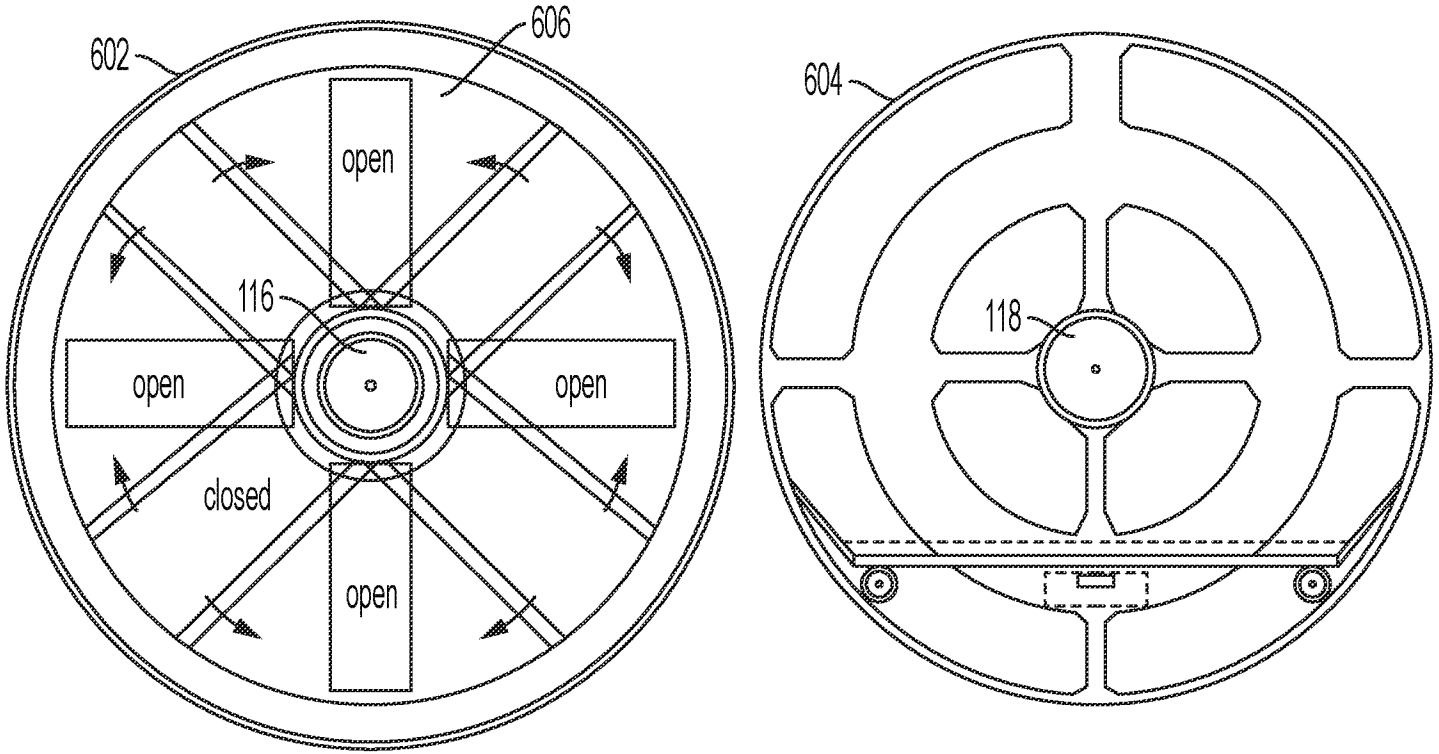
FIG. 6 illustrates an inlet end and an outlet end of the material collection device of FIG. 2, according to some embodiments.

FIG. 6 illustrates an inlet end 602 and an outlet end 604 of the material collection device 200 of FIG. 2, according to some embodiments. The inlet end 602 may include a valve that may be opened or closed to allow or impede fluid (e.g., water) from the body of water to enter the collection chamber 210. The outlet end 604 may allow fluid to exit the collection chamber 210. As a result, the fluid may flow through the material collection device 200. By way of non-limiting example, the material collection device 200 may be submerged in the fluid and a current of the body of water may move water through the material collection device 200. In some embodiments a mesh 606 may be included behind the inlet end 602 to prevent debris from entering the collection chamber 210 and resting on the collector 202 or interfering with the particles as they descend from the filter tube 300 toward the collector 202.

Figure 7:
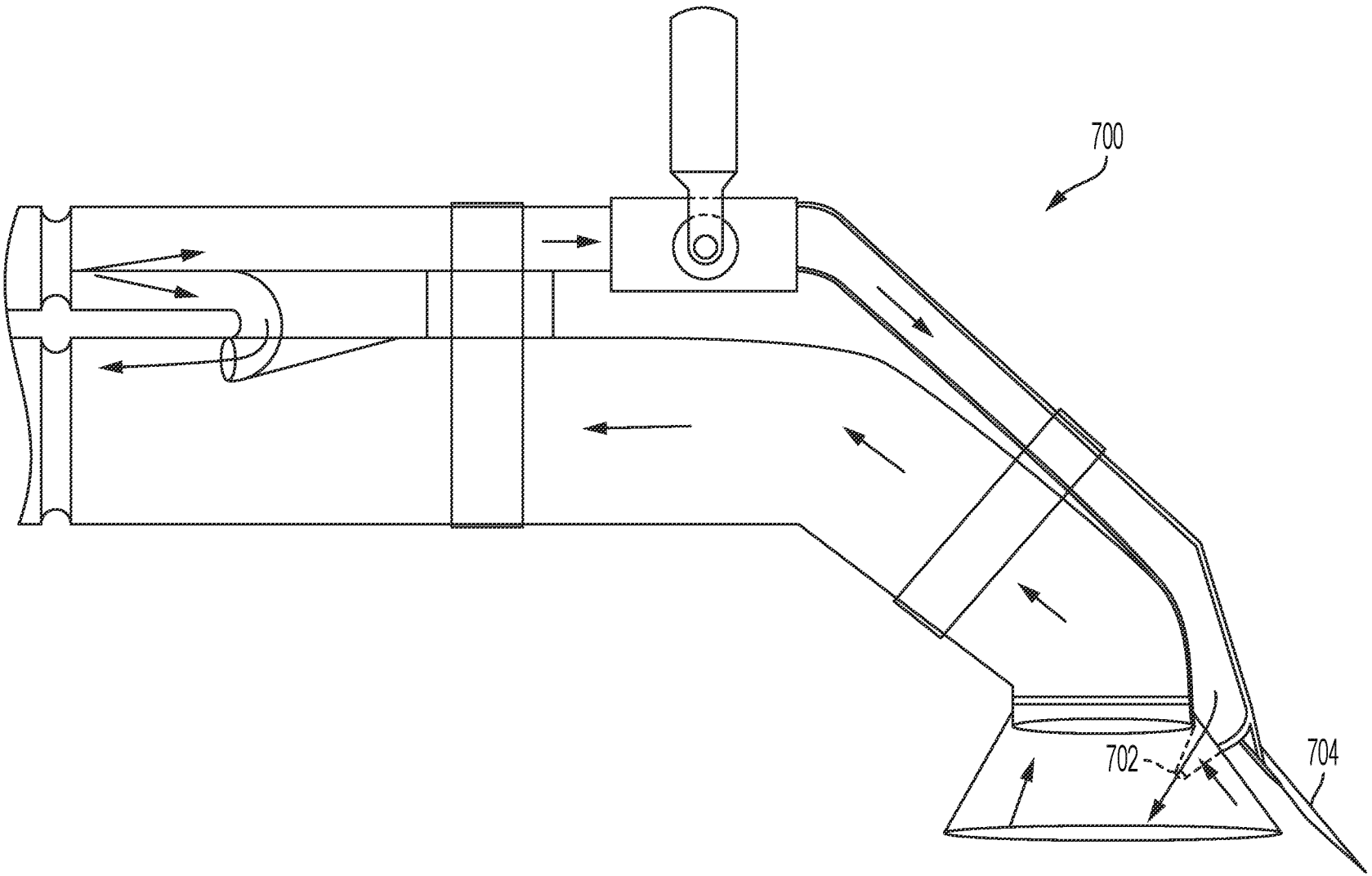
FIG. 7 is a material intake device, which is an example of a material intake device of FIG. 1, according to some embodiments.

FIG. 7 is a material intake device 700, which is an example of the material intake device 102 of FIG. 1, according to some embodiments. The material intake device 700 includes a nozzle 702 at an end thereof. The nozzle 702 is configured to propel fluid into the streambed to dislodge the material (e.g., material 108 of FIG. 1) from the streambed. The material intake device 700 also includes a dislodging tool at the end of the material intake device 700. The material intake device 700 is configured to dislodge the material from the streambed. By way of non-limiting example, the dislodging tool may include a spike 704 configured for insertion into the streambed to enable an operator of the material intake device 102 to churn through the streambed with the spike 704 to dislodge the material from the streambed.

Other dislodging tools may be used at the end of the material intake device 102 in some embodiments. By way of non-limiting example, a dislodging tool may include a driven wheel having one or more teeth protruding therefrom. An example of a dislodging tool having a driven wheel and one or more teeth protruding therefrom is illustrated in FIG. 8A.

Figure 8B:
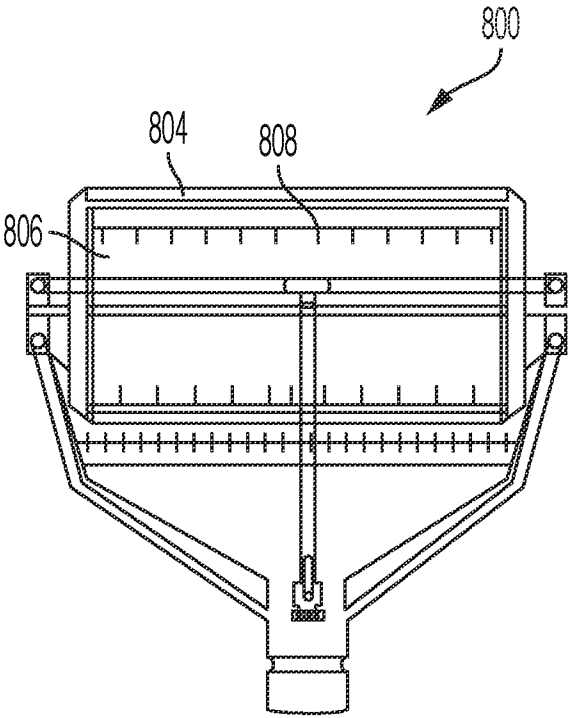
FIG. 8B illustrates a bottom view of the dislodging tool, according to some embodiments.
Figure 8A:
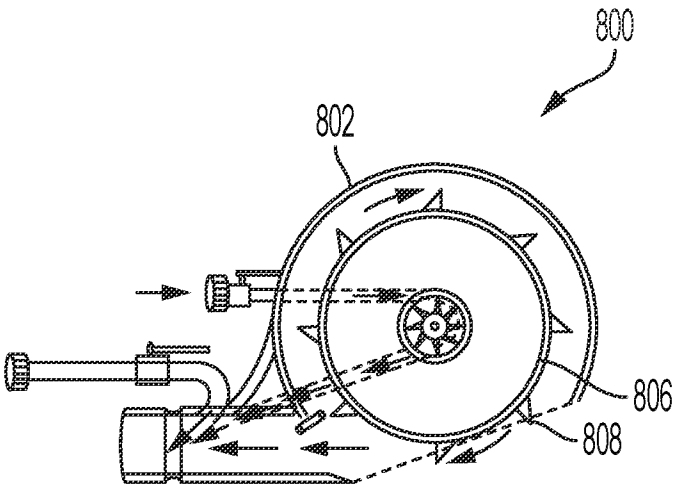
FIG. 8A illustrates a side view of a dislodging tool, according to some embodiments.

FIG. 8A illustrates a side view 802 of a dislodging tool 800, according to some embodiments.

FIG. 8B illustrates a bottom view 804 of the dislodging tool 800, according to some embodiments. Referring to FIG. 8A and FIG. 8B together, in some embodiments the dislodging tool 800 may be positioned at the end of a material intake device such as the material intake device 102 of FIG. 1 to dislodge material (e.g., material 108 of FIG. 1) from a streambed (e.g., the streambed 112 of FIG. 1). The dislodging tool 800 includes a wheel 806 having teeth 808. When the wheel 806 is driven to spin (e.g., by fluid turning the wheel 806 as illustrated by the side view 802) the teeth 808 dislodge material that the material intake device may intake.

Figure 9:
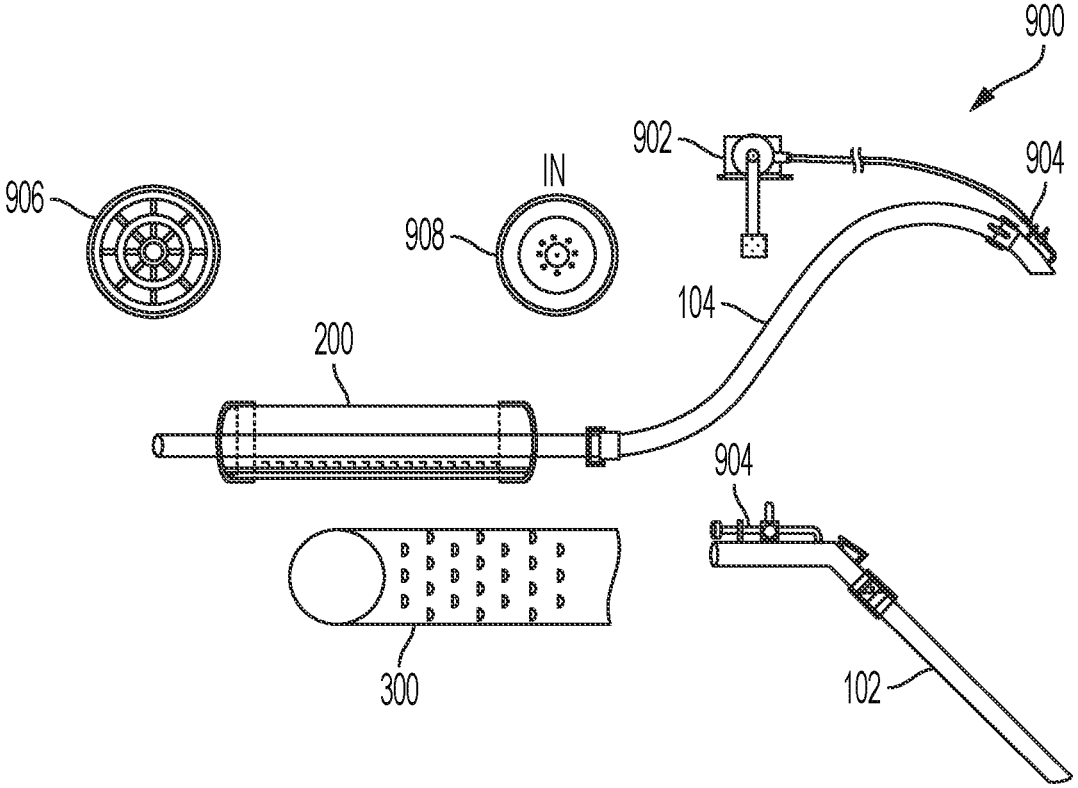
FIG. 9 is a side view of a placer recovery system, which is an example of the placer recovery system of FIG. 1 implementing a water pump.

FIG. 9 is a side view of a placer recovery system 900, which is an example of the placer recovery system 100 of FIG. 1 implementing a water pump 902. The placer recovery system 900 includes the material collection device 200, the filter tube 300, the material transmission device 104, and the material intake device 102 discussed above with reference to FIG. 1. The placer recovery system 900 also includes an outlet end 906 and an inlet end 908 for the material collection device 200. The outlet end 906 and the inlet end 908 are similar to the outlet end 604 and the inlet end 602 discussed with reference to FIG. 6.

The placer recovery system 900 also includes a pump connector 904 configured to connect to the water pump 902. The water pump 902 may in some embodiments drive the flow of fluid and material through the placer recovery system 900. In such embodiments the water pump 902 may be configured to move the material and the fluid through the filter tube 300 of the material collection device 200. In some embodiments naturally occurring current flowing through the material collection device 200 may drive the flow of fluid through a placer recovery system 100 in addition to or instead of the water pump 902. By way of non-limiting example, the material intake device 102 may be used upstream from the material collection device 200 and current operating on the material collection device 200 may create suction in the material transmission device 104, similar to siphoning of gasoline from a gas tank.

Figure 10:
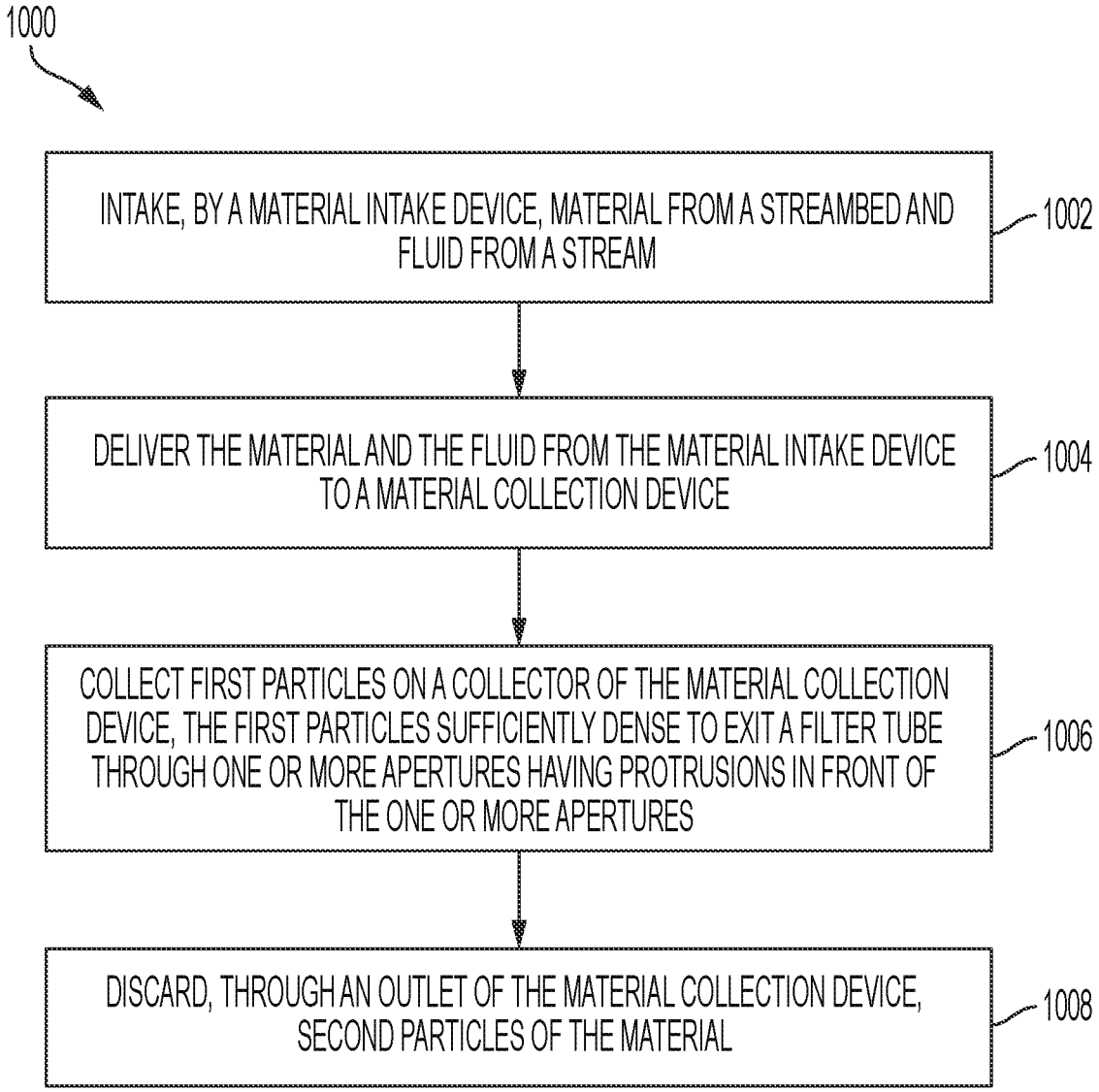
FIG. 10 is a flowchart illustrating a method of operating a placer recovery system, according to some embodiments.

FIG. 10 is a flowchart illustrating a method 1000 of operating a placer recovery system, according to some embodiments. In operation 1002, method 1000 includes intaking, by a material intake device, material from a streambed and fluid from a stream. In operation 1004, method 1000 includes delivering the material and the fluid from the material intake device to a material collection device. In operation 1006, method 1000 includes collecting first particles on a collector of the material collection device, the first particles sufficiently dense to exit a filter tube through one or more apertures having protrusions in front of the one or more apertures. In operation 1008, method 1000 includes discarding, through an outlet of the material collection device, second particles of the material.

As used in the present disclosure, the term "combination" with reference to a plurality of elements may include a combination of all the elements or any of various different subcombinations of some of the elements. For example, the phrase "A, B, C, D, or combinations thereof" may refer to any one of A, B, C, or D; the combination of each of A, B, C, and D; and any subcombination of A, B, C, or D such as A, B, and C; A, B, and D; A, C, and D; B, C, and D; A and B; A and C; A and D; B and C; B and D; or C and D.

Terms used in the present disclosure and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

While the present disclosure has been described herein with respect to certain illustrated embodiments, those of ordinary skill in the art will recognize and appreciate that the present invention is not so limited. Rather, many additions, deletions, and modifications to the illustrated and described embodiments may be made without departing from the scope of the invention as hereinafter claimed along with their legal equivalents. In addition, features from one embodiment may be combined with features of another embodiment while still being encompassed within the scope of the invention as contemplated by the inventor.

What is claimed is:

1. A material collection device, comprising:
- a filter tube including:
  - a wall defining apertures;
  - an inlet through which fluid and material enter the filter tube;
  - protrusions extending inwardly from the wall of the filter tube, the protrusions in front of the apertures from a perspective of the inlet; and
  - an outlet through which the fluid and material exit the filter tube;
- a collector positioned below the filter tube, the collector configured to collect particles of the material that exit the filter tube through the apertures; and
- a shell defining a collection chamber, the filter tube extending through the collection chamber, the collector positioned within the collection chamber, the collector including rollers configured to engage with an inner surface of the shell to maintain the collector in a substantially horizontal orientation under the filter tube regardless of an orientation of the material collection device.

2. The material collection device of claim 1, wherein the collector includes ridges on a top surface thereof to prevent collected particles that collect thereon from leaving the top surface.

3. The material collection device of claim 1, wherein the collector includes eddy features in a top surface thereof.

4. The material collection device of claim 1, wherein the apertures and their corresponding protrusions are arranged all around the wall to enable the particles of the material to exit the filter tube through the apertures regardless of an orientation of the filter tube.

5. The material collection device of claim 1, wherein the filter tube includes outward protrusions that protrude outwards from the wall, the outward protrusions positioned behind the apertures from the perspective of the inlet.

6. The material collection device of claim 5, wherein an angle between a line perpendicular to the wall and a line from a tip of one of the protrusions to a tip of a corresponding one of the outward protrusions is between 5° and 55°.

7. The material collection device of claim 6, wherein the angle is substantially 30°.

8. A placer recovery system, comprising:
- a material collection device, comprising:
  - a filter tube extending therethrough, the filter tube including apertures and protrusions in front of the apertures from a perspective of an inlet of the filter tube, the protrusions extending inward into the filter tube; and
  - a collector positioned below the filter tube;

a material intake device to intake material from a streambed and fluid from a stream;

a material transmission device to deliver the material and fluid from the material intake device to the material collection device; and a shell defining a collection chamber, the filter tube extending through the collection chamber, the collector positioned within the collection chamber, the collector including rollers configured to engage with an inner surface of the shell to maintain the collector in a substantially horizontal orientation under the filter tube regardless of an orientation of the material collection device.

9. The placer recovery system of claim 8, wherein the material intake device includes a nozzle at an end thereof, the nozzle configured to propel fluid into the streambed to dislodge the material from the streambed.

10. The placer recovery system of claim 8, wherein the material intake device includes a dislodging tool at the end thereof, the dislodging tool configured to dislodge the material from the streambed.

11. The placer recovery system of claim 10, wherein the dislodging tool includes a spike configured for insertion into the streambed to enable an operator of the material intake device to churn through the streambed with the spike to dislodge the material from the streambed.

12. The placer recovery system of claim 10, wherein the dislodging tool includes a driven wheel having one or more teeth protruding therefrom.

13. The placer recovery system of claim 8, further comprising a pump configured to move the material and the fluid through the filter tube.

14. The placer recovery system of claim 8, wherein the collector includes one or more of eddy features or ridges in a top surface thereof.

15. The placer recovery system of claim 8, wherein:

the filter tube includes outward protrusions that protrude outwards from the filter tube, the outward protrusions positioned behind the apertures from the perspective of the inlet; and an angle between a line perpendicular to a wall of the filter tube and a line from a tip of one of the protrusions to a tip of a corresponding one of the outward protrusions is between 5° and 55°.

16. A method of operating a material collection device, the method comprising:

intaking, by a material intake device, material from a streambed and fluid from a stream;

delivering the material and the fluid from the material intake device to an inlet of a filter tube extending through a collection chamber defined by a shell, the filter tube including a wall defining apertures and protrusions extending inwardly from the wall of the filter tube, the protrusions in front of the apertures from a perspective of the inlet; and collecting first particles that exit the filter tube through the apertures on a collector of the material collection device, the first particles sufficiently dense to exit the filter tube through the apertures;

maintaining the collector in a substantially horizontal orientation under the filter tube regardless of an orientation of the material collection device responsive to rollers of the collector engaging with an inner surface of the shell; and discarding, through an outlet of the filter tube, second particles of the material, the second particles too buoyant to exit the filter tube through the apertures.

* * * * *